US005178056A

United States Patent [19]

Mai

[11] Patent Number: 5,178,056

[45] Date of Patent: Jan. 12, 1993

[54] FLUID DRIVEN WORKING CYLINDER WITHOUT A PISTON ROD

[75] Inventor: Dieter Mai, Kaufering, Fed. Rep. of Germany

[73] Assignee: Airtec Pneumatik GmbH, Kronberg/Taunus, Fed. Rep. of Germany

[21] Appl. No.: 749,842

[22] Filed: Aug. 26, 1991

[30] Foreign Application Priority Data

Aug. 31, 1990 [DE] Fed. Rep. of Germany ..... 4027636

[51] Int. Cl.[5] ..... F01B 29/00

[52] U.S. Cl. ..... 92/88; 92/137; 277/DIG. 7

[58] Field of Search ..... 92/88, 137; 277/DIG. 7

[56] References Cited

U.S. PATENT DOCUMENTS

| | | | |
|---|---|---|---|
| 4,252,285 | 2/1981 | Hammond et al. | 92/88 X |
| 4,337,845 | 6/1982 | Zelli et al. | 92/137 X |
| 4,714,007 | 12/1987 | Maisch | 92/88 |
| 4,733,604 | 3/1988 | Lipinski | 92/88 |
| 4,856,415 | 8/1989 | Noda | 92/88 |
| 4,991,494 | 2/1991 | Migliori | 92/88 |
| 5,020,421 | 6/1991 | Podlesak | 92/137 |
| 5,022,311 | 6/1991 | Fortmann et al. | 92/137 |
| 5,035,171 | 7/1991 | Gottling et al. | 92/137 |

FOREIGN PATENT DOCUMENTS

| | | | |
|---|---|---|---|
| 0068088 | 1/1983 | European Pat. Off. | 92/88 |
| 0177880 | 10/1985 | European Pat. Off. . | |
| 952308 | 10/1956 | Fed. Rep. of Germany . | |
| 2706163 | 2/1977 | Fed. Rep. of Germany . | |
| 2939153 | 9/1979 | Fed. Rep. of Germany . | |
| 3505167 | 2/1985 | Fed. Rep. of Germany . | |
| 3509891 | 3/1985 | Fed. Rep. of Germany . | |
| 8801698 | 3/1988 | PCT Int'l Appl. . | |
| 2051957 | 1/1981 | United Kingdom . | |

*Primary Examiner*—Edward K. Look
*Assistant Examiner*—John Ryznic
*Attorney, Agent, or Firm*—Panitch Schwarze Jacobs & Nadel

[57] ABSTRACT

A fluid-driven working cylinder without a piston rod is provided with a cylinder housing (4) which in cross-section is fully closed, and along which a force takeaway (1) is guided without turning. The force takeaway (1) is connected with a band (7) that extends respectively from each of the ends of the cylinder housing (4) and is fastened to the piston. The band (7) is externally guided over two reversing wheels. To avoid leaks of the cylinder housing (4) during pressurization the interior of the cylinder housing (4) is divided into a piston space (8), in which the working piston is moved back and forth, and a band space (9), which is separated from piston space (8), but which is connected with the piston space (8) by means of a longitudional slit (10) which is sealed off by a sealing strip (5). Band (7) runs in the band space (9) and is connected to the piston by means of linkage (6) which projects through the longitudinal slit (10). This construction permits the preferred usage of a toothed belt or a chain as a band.

6 Claims, 2 Drawing Sheets

FLUID DRIVEN WORKING CYLINDER WITHOUT A PISTON ROD

FIELD OF THE INVENTION

The invention is directed to a fluid driven working cylinder without a piston rod. More particularly, the present invention is directed to a working cylinder with a purely mechanical coupling between piston and force reducer.

BACKGROUND OF THE INVENTION

In the field of working cylinders without piston rods, various types of force takeaway have emerged in practice. There are known fluid-driven working cylinders without piston rods, which have force takeaways guided on the outside of the cylinder tube. These can be coupled mechanically or magnetically with the piston. The mechanical connection can occur by means of an encircling transfer element, particularly a band or cable (EP-0 177 880 B1), or by means of a rigid linkage member between the piston and the force takeaway. In the latter case the linkage member passes through a sealable slit in the cylinder tube (EP-0 190 760 Al, DE 3509891 A1).

The sealing of the cylinder ends, through which the band or cable (wire rope) passes, is problematic with the known band or cable cylinders. Usually these bands are steel bands with almost a rectangular cross section. It is understandable that the sealing at the cylinder ends is extremely difficult to achieve during rapid movement of the piston to which the bands are fastened. The sealing lips of the seals must adjust themselves to the band within a short period of time.

In addition there is the following problem, since in practice steel bands with a thickness of 0.2 mm are usually used as bands. These are so sensitive, that due to the effect of stress concentration, which in turn is attributable to scratches on the surface—possibly caused by handling with a tool—they are prone to tearing.

The following problem occurs in the case of using a cable, namely, that the surface of the cable is in itself uneven, and hence leaks are to be expected from this.

In DE-PS 952 308 the usage of a chain or toothed chain as a "band" has been proposed, but in a working cylinder where the band space, which is separated from the piston space, is pressurized when pressure fluid is introduced into the piston space in order to move the piston in one direction or another. The described working cylinder in the referenced document is an internally pressurized working cylinder, in which the band space is not separated from the piston space in the sense of pressure.

WO 88/01698 A1 shows a further internally pressurized working cylinder without a piston rod. Therein the translational movement of the piston is converted to a rotary movement of the reversing pulleys and thereafter outside of the cylinder this rotary movement is converted again to a translational movement of a force takeaway. With this cylinder losses are of course incurred. The band is guided in a band space as in the case of the DE-PS 952308, which has been pressurized with the same pressure as the one side of the piston space. A stored sealing element, which slides in the band space, connects within the band space both ends of the band, which is shaped as a toothed belt. Since the cylinder is an internally pressurized cylinder, the band space is therefore not separated from the piston space in the sense of pressure. This sealing element basically works like a small piston, which is being pushed in the same direction as the working piston as a result of pressurization of the band space. This sealing element therefore entails a force as a planned feature which pushes against the piston by reason of its effective surface, which is set against the active force of the piston, whereby the efficiency of the cylinder is drastically reduced.

In cases of a working cylinder with a stiff linkage member between the piston and force takeaway, the problem of leakage develops first at the entry point of the linkage member. In addition one has to consider that, in the case of pressurization of the cylinder tube in order to move the piston therein, the cylinder will have a tendency to expand. Of course, the slit for the linkage member offers the ideal location for an expansion of the cylinder tube, during the momement of operation of the piston. This means that during pressurization of the cylinder tube, the leakage of the cylinder is increased. As a solution for this problem it has already been suggested to use a cylinder tube with variable wall thickness, such that the thickness of the wall is greater on the side opposite the slit (EP-0290760 A1, FIG. 2, DE 3509891 A). By this means the thicker material should work against a bowing out of the tube.

According to another suggestion (EP-0068088 B1) the force takeaway is provided in such a way to grip the cylinder tube in a clamp-style, in order to counteract the expansion in the area of the longitudional slit.

If one considers now that known working cylinders are driven with an approximate air pressure of 6-10 bar, it becomes clear that expansions of even a few tenths of a millimeter can drastically reduce the efficiency of such a cylinder.

In view of the above background it is now the object of the present invention to create a working cylinder without a piston rod, wherein the stated sealing problems of other known working cylinders are not present.

SUMMARY OF THE INVENTION

One can solve these problems with the special shape of the inner profile of the cylinder housing according to the present invention. Hence, its interior is divided into a piston space and a band space and is closed completely towards the outside—except for the passage slits (exits) for the band at the cylinder ends. The piston space and the band space are connected with each other through a longitudional slit, which is sealed off by means of a sealing strip. By this means the band space is not pressurized during pressurization of the piston space.

The piston is equipped with a linkage member, which projects through the longitudional slit and through the radially directed (i.e. to the band space) sealing strips into the band space. The dimensions of the linkage member are very small in comparison to the linkage members of known slit cylinders.

The linkage member which reaches into the band space is itself connected with the band at its end. This can be achieved by suitable means, for example by welding or by means of a knee joint.

The band exits at the ends of the cylinder housing, more specifically in the area of the band space, in order by way of two reversing wheels in known manner to be connected in force-transmitting manner to the force takeaway which is guided on the cylinder housing.

The tightness of the working cylinder can also be increased by additionally sealing off the ends of the cylinder housing in the area of the passage of the band, namely the ends of the band space. Indeed, the band space is anyway practically non-pressurized upon pressurization of the piston space, according to the invention. The additional sealing off nevertheless increases the efficiency even more.

In addition, these means permit the band, which is generally a steel band or cable, to be instead in the form of a toothed belt or chain. With the conventional constructions of the inner profile of the cylinder this would only be possible by accepting extreme leaks of the cylinder.

Consistent with formation of the band as a toothed belt or chain, the usual reversing wheels are formed instead as toothed belt or sprocket wheels, respectively. The advantage of these means, which is only possible on the basis of the inner profile of the cylinder according to the invention, can be seen in that besides the power connection between band and reversing wheel a design connection also comes about, which permits additional functions of the reversing wheels. That is how, for example, it is possible to have a stationary brake acting on the reversing wheel, as described in the parallel German patent application P 40 27 617.1-14 filed by applicant on the same day as the priority application for the present invention. On the basis of the form and power connections between the reversing wheel and the toothed belt or chain, respectively, there is no slippage during braking, as occurs for example, with steel bands. Therefore, an absolutely exact and reproduceable positioning of the piston and the force takeaway, respectively, is made possible.

BRIEF DESCRIPTION OF THE DRAWINGS

The foregoing summary, as well as the following detailed description of the presently preferred embodiment of the invention, will be better understood when read in conjunction with the appended drawings. It is understood, however, that this invention is not limited to the precise arrangement illustrated. For ease of representation, the piston and the reversing wheels are not shown.

DETAILED DESCRIPTION OF PREFERRED EMBODIMENTS

Figure 1:
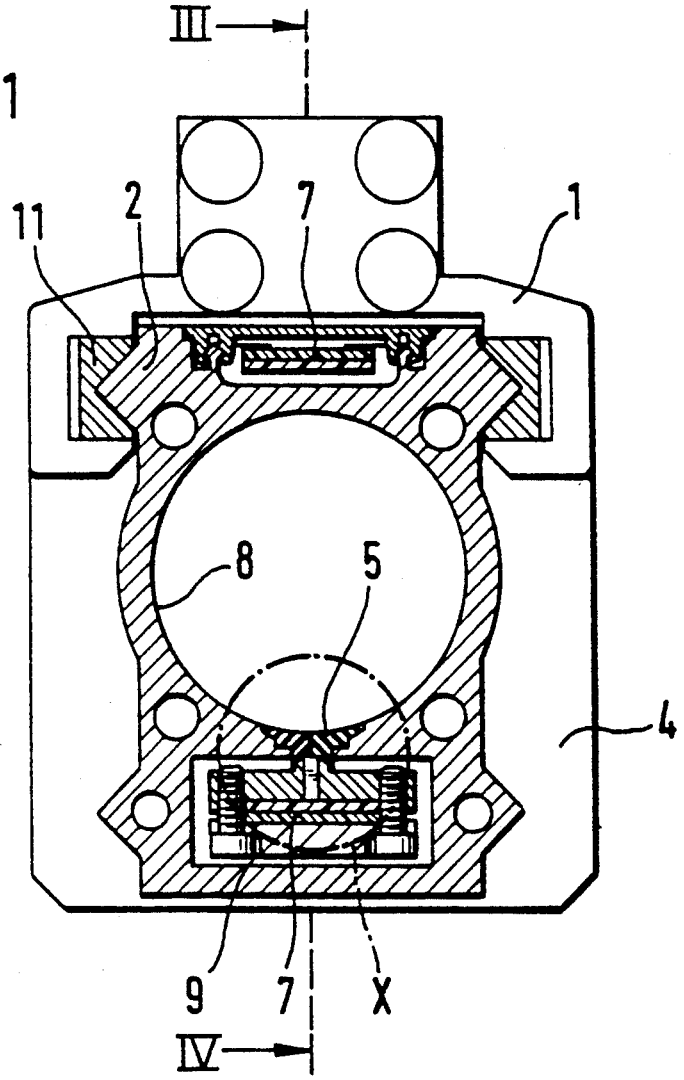
FIG. 1 is a cross-sectional view of a working cylinder according to the present invention.

Shown in the drawing is the cylinder housing 4 with the piston space 8 and the band space 9. It is important that the inner profile of the housing be sealed off completely from the outside, so that upon pressurization of the piston space 8 leaks through connecting joints (not shown) are impossible.

Figure 2:
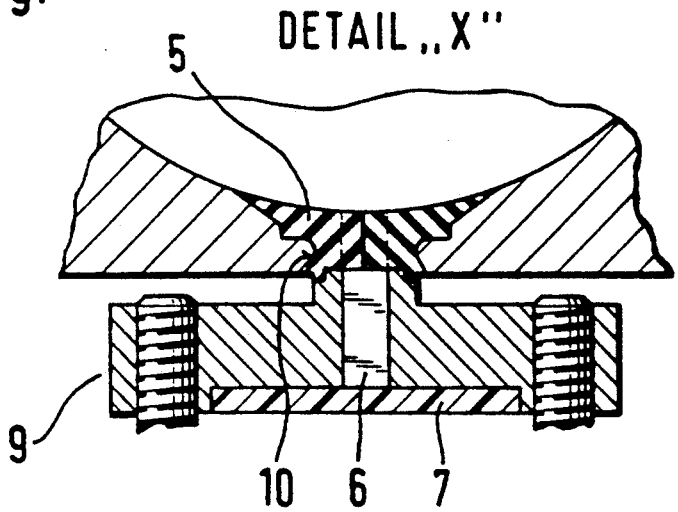
FIG. 2 is an enlarged cross-sectional view of the detail X encompassed by the dotted circle in FIG. 1.

The band space 9 is connected with the piston space 8 by means of a longitudional slit 10. The longitudional slit 10 is sealed off by a sealing strip. Only at the location of entry of the linkage member 6 between the piston and the band 7 does the seal bow out of the slit 10 radially inwardly into the piston space 8, as is hinted at schematically in the enlarged detail of this space shown in FIG. 2. Band 7 which runs in band space 9 is connected by means of linkage member 6.

The band 7 exits the cylinder housing 4 at the ends 12 whereby for further enhancement of the tightness of the system additional seals 13 can be arranged at these exit points.

Band 7 is guided over reversing wheels 14 and connected to force takeaway 1, which in the embodiment shown can be moved back and forth on prismatic guides 2, 11 on the upper side of the cylinder housing.

Figure 3:
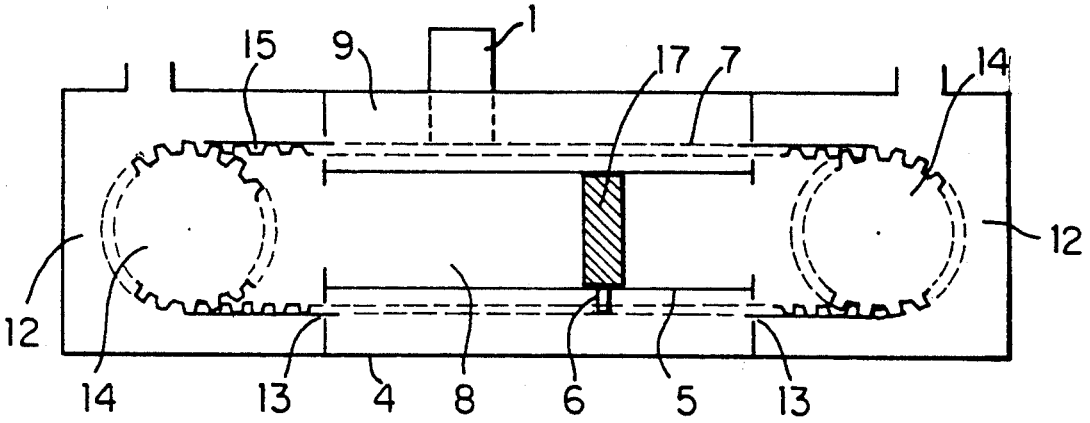
FIG. 3 is a schematic side section view of a working cylinder of the invention taken through line III-IV in FIG. 1 in which the band is a toothed belt and the reversing wheels are tooth belt wheels.
Figure 4:
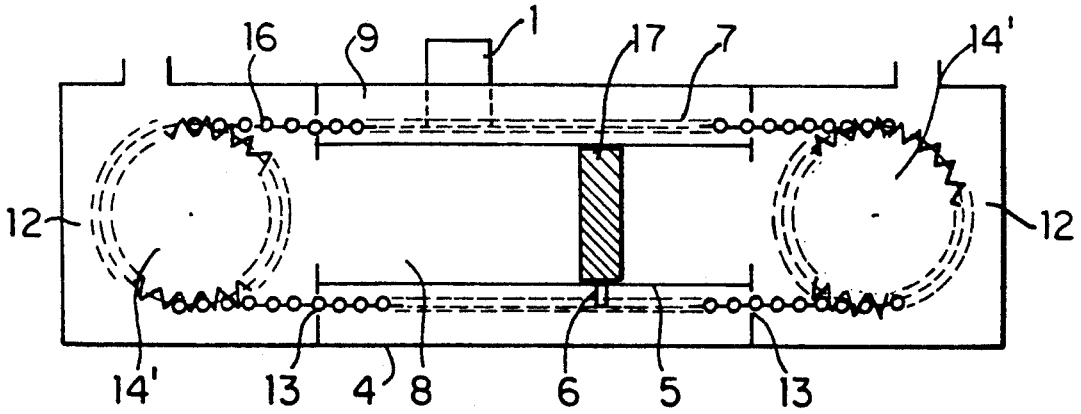
FIG. 4 is a schematic side section view of a working cylinder according to the invention also taken along line III-IV of FIG. 1 where the band is a chain and the reversing wheels are sprocket wheels.

The novel inner profile of the cylinder housing permits the usage of a toothed belt 15 and tooth belt wheels 14 (FIG. 3) or a chain 16 and sprocket wheels 14' (FIG. 4) as a "band", especially when the exit slits for the band are additionally sealed off at the cylinder ends.

An expansion of the profile is not possible, as is the case with pressurization in conventional slit cylinders. Also the problem of sealing of conventional band cylinders at the cylinder heads does not occur, since the main sealing effect of the proposed working cylinder is accomplished by the sealing strip 5 in the inside of the profile, so that the band space 9 is already non-pressurized.

The present invention may be embodied in other specific forms without departing from the spirit or essential attributes thereof and, accordingly, reference should be made to the appended claims, rather than to the foregoing specification as indicating the scope of the invention.

I claim:

1. A fluid driven working cylinder without a piston rod, comprising a cylinder housing (4) which in cross-section is completely closed, a force takeaway (1) which is guided along the cylinder housing without turning, a band (7) which is connected to the force takeaway and extends from the ends of the cylinder housing (4) and is fastened to a working piston, the band (7) being externally guided over two reversing wheels, wherein the interior of the cylinder housing (4) is divided into a piston space (8), in which the working piston is movable back and forth, and a band space (9), which is separated from the piston space (8), the band space (4) being connected with piston space (8) by means of a longitudional slit (10) which is sealed with a sealing strip (5), whereby upon pressurization of the piston space (8) the band space (9) is non-pressurized, and wherein the band (7) runs in the band space (9) and is connected with the piston by means of a linkage (6) which projects through longitudional slit (10).

2. A working cylinder according to claim 1, wherein the ends of the cylinder housing (4) are additionally sealed at the places where the band (7) exits the band space (9).

3. A working cylinder according to claim 2, wherein the band (7) comprises a toothed belt and the reversing wheels comprise tooth belt wheels.

4. A working cylinder according to claim 2, wherein the band (7) comprises a chain and the reversing wheels comprise sprocket wheels.

5. A working cylinder according to claim 1, wherein the band (7) comprises a toothed belt and the reversing wheels comprise tooth belt wheels.

6. A working cylinder according to claim 1, wherein the band (7) comprises a chain and the reversing wheels comprise sprocket wheels.

* * * * *